US008276237B2

(12) United States Patent
Bukovitz

(10) Patent No.: US 8,276,237 B2
(45) Date of Patent: Oct. 2, 2012

(54) PAINT ROLLER COVER SUPPORT WITH EXPANDABLE SLEEVE SEGMENTS

(75) Inventor: Richard K. Bukovitz, Orrville, OH (US)

(73) Assignee: The Wooster Brush Company, Wooster, OH (US)

( * ) Notice: Subject to any disclaimer, the term of this patent is extended or adjusted under 35 U.S.C. 154(b) by 560 days.

(21) Appl. No.: 12/631,043

(22) Filed: Dec. 4, 2009

(65) Prior Publication Data

US 2010/0139560 A1 Jun. 10, 2010

Related U.S. Application Data

(60) Provisional application No. 61/120,733, filed on Dec. 8, 2008.

(51) Int. Cl.
*B05C 17/02* (2006.01)

(52) U.S. Cl. ..... 15/230.11; 492/19

(58) Field of Classification Search ..... 15/230.11; 492/13, 19

See application file for complete search history.

(56) References Cited

U.S. PATENT DOCUMENTS

| | | | | |
|---|---|---|---|---|
| 2,520,863 A | | 8/1950 | Thomas et al. | |
| 2,647,299 A | | 8/1953 | Thomas | |
| 2,747,210 A | * | 5/1956 | Canning et al. | 15/230.11 |
| 2,747,211 A | * | 5/1956 | Touchett | 15/230.11 |
| 2,815,563 A | * | 12/1957 | Weber | 492/19 |
| 2,970,366 A | | 2/1961 | Gill | |
| 2,987,746 A | | 6/1961 | Davis et al. | |
| 3,019,466 A | * | 2/1962 | Denholtz | 15/230.11 |
| 3,060,555 A | | 10/1962 | Kirshenbaum et al. | |
| 3,094,770 A | * | 6/1963 | Williams | 492/19 |
| 3,165,772 A | * | 1/1965 | McGinley | 15/230.11 |
| 3,229,319 A | * | 1/1966 | Goetz | 15/230.11 |
| 3,335,446 A | * | 8/1967 | McGinley | 15/230.11 |
| 5,167,055 A | | 12/1992 | Stoddart et al. | |
| 5,515,781 A | | 5/1996 | Songer | |
| 6,378,158 B1 | | 4/2002 | Bukovitz | |

FOREIGN PATENT DOCUMENTS

WO WO 2009/043162 A1 4/2009

OTHER PUBLICATIONS

PCT/US2009/066770—International Search Report and Written Opinion of the International Searching Authority mailed Jan. 29, 2010 (enclosed).

* cited by examiner

*Primary Examiner* — Mark Spisich
(74) *Attorney, Agent, or Firm* — Renner, Otto, Boisselle & Sklar, LLP

(57) ABSTRACT

Paint roller cover support includes a cage assembly mounted for rotation and limited axial movement in opposite directions on the shaft portion of a roller frame. The cage assembly includes a plurality of circumferentially spaced axially extending semi-cylindrical sleeve segments that move radially outward and inward relative to the shaft portion during axial movement of the cage assembly in opposite directions. Elastomeric rings surrounding opposite ends of the sleeve segments maintain cam members on the sleeve segments in engagement with cam lifters on respective hub members on the shaft portion. Both the elastomeric rings and elastomeric material attached to radial outer surfaces of the sleeve segments may be pressed into frictional engagement with the inner diameter of a surrounding roller cover during radial outward movement of the sleeve segments for securely retaining the roller cover on the support.

20 Claims, 3 Drawing Sheets

PAINT ROLLER COVER SUPPORT WITH EXPANDABLE SLEEVE SEGMENTS

CROSS-REFERENCE TO RELATED APPLICATIONS

This application claims the benefit of U.S. Provisional Application Ser. No. 61/120,733, filed Dec. 8, 2008, the entire disclosure of which is incorporated herein by reference.

FIELD OF THE INVENTION

This invention relates generally to rotatable supports for paint roller covers that include expandable sleeve segments that are mechanically expandable into engagement with the inner diameter of the roller covers for securely retaining the roller covers in place on the supports.

BACKGROUND OF THE INVENTION

Paint roller cover supports are typically rotatably mounted on a shaft portion of a roller frame, and are adapted to receive a cylindrical roller cover that is designed to hold paint or other coating material (hereinafter collectively "paint") for coating a variety of surfaces including but not limited to walls, ceilings, floors, decking and fencing of various compositions and textures.

It is generally known to provide paint roller cover supports that allow for relatively easy insertion and removal of roller covers therefrom and also fairly well retain the roller covers in place on the roller cover supports during use as long as the roller covers have a substantially rigid core.

However, there is an ongoing need for roller cover supports that also provide sufficient gripping force to retain roller covers in place on the roller cover supports without slippage during use regardless of whether the roller covers have substantially rigid cores or whether the roller covers are coreless. For example, in some cases the roller cover cores may not be substantially rigid or the roller covers may simply be attached to a substrate or backing material that provides sufficient stability to the roller covers without the need for a core.

SUMMARY OF THE INVENTION

The paint roller cover support of the present invention includes a plurality of circumferentially spaced axially extending semi-cylindrical sleeve segments that are rotatably mounted on a shaft portion of a paint roller frame and are radially movable relative to the shaft portion between a contracted condition to allow for easy insertion of the roller cover onto the support and an expanded condition for securely retaining the roller cover in place on the support.

In accordance with one aspect of the invention, elastomeric material attached to radial outer surfaces of each of the sleeve segments is pressed into frictional engagement with the inner diameter of a surrounding roller cover during radial outward movement of the sleeve segments relative to the shaft portion to securely retain the roller cover in place on the support.

In accordance with another aspect of the invention, each of the semi-cylindrical sleeve segments has a plurality of axially spaced cam surfaces that are maintained in engagement with cam lifters on axially spaced hub members on the shaft portion for causing radial outward and inward movement of the sleeve segments relative to the shaft portion during axial movement of the sleeve segments in opposite directions.

In accordance with another aspect of the invention, opposite ends of all of the sleeve segments are surrounded by elastomeric rings that maintain the cam members on the sleeve segments in engagement with the cam lifters on the hub members.

In accordance with another aspect of the invention, the elastomeric material substantially covers the radial outer surfaces of the sleeve segments intermediate the elastomeric rings.

In accordance with another aspect of the invention, the sleeve segments are part of a cage assembly that includes axially spaced inboard and outboard end caps joined together by a plurality of circumferentially spaced axially extending guide rails.

In accordance with another aspect of the invention, the sleeve segments are interposed between adjacent pairs of such guide rails.

In accordance with another aspect of the invention, the sleeve segments have outer side edges that overlie outer edges of respective adjacent pairs of guide rails when the sleeve segments are in their radial innermost positions.

In accordance with another aspect of the invention, respective ends of the elastomeric rings sealingly engage radial outer surfaces of the respective end caps when the sleeve segments are in the expanded condition with the elastomeric material and the elastomeric rings pressed into frictional engagement with the inner diameter of a surrounding roller cover to prevent paint from migrating between the elastomeric rings and end caps into the cage assembly.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and annexed drawings setting forth in detail certain illustrative embodiments of the invention, these being indicative, however, of but several of the various ways in which the principles of the invention may be employed.

DETAILED DESCRIPTION OF THE INVENTION

Figure 1:
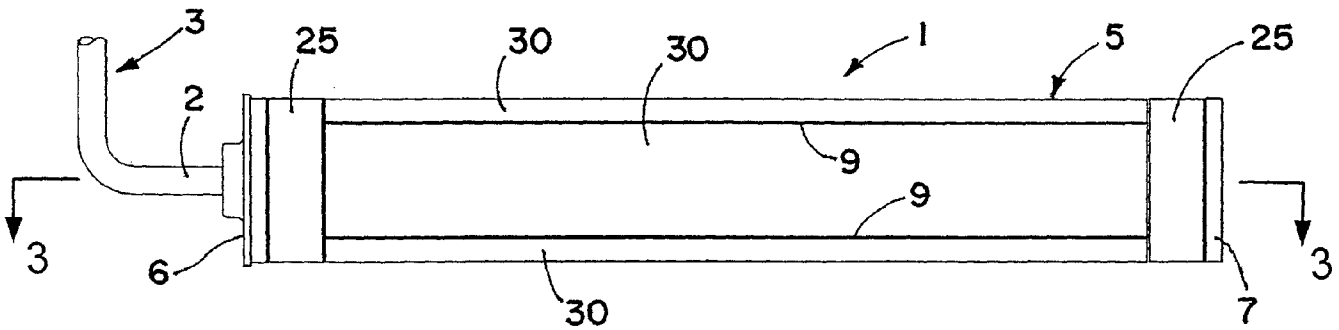
FIG. 1 is a schematic side elevation view of one form of roller cover support of the present invention showing the expandable sleeve segments in a contracted condition to allow for easy insertion of a roller cover onto the support.
Figure 2:
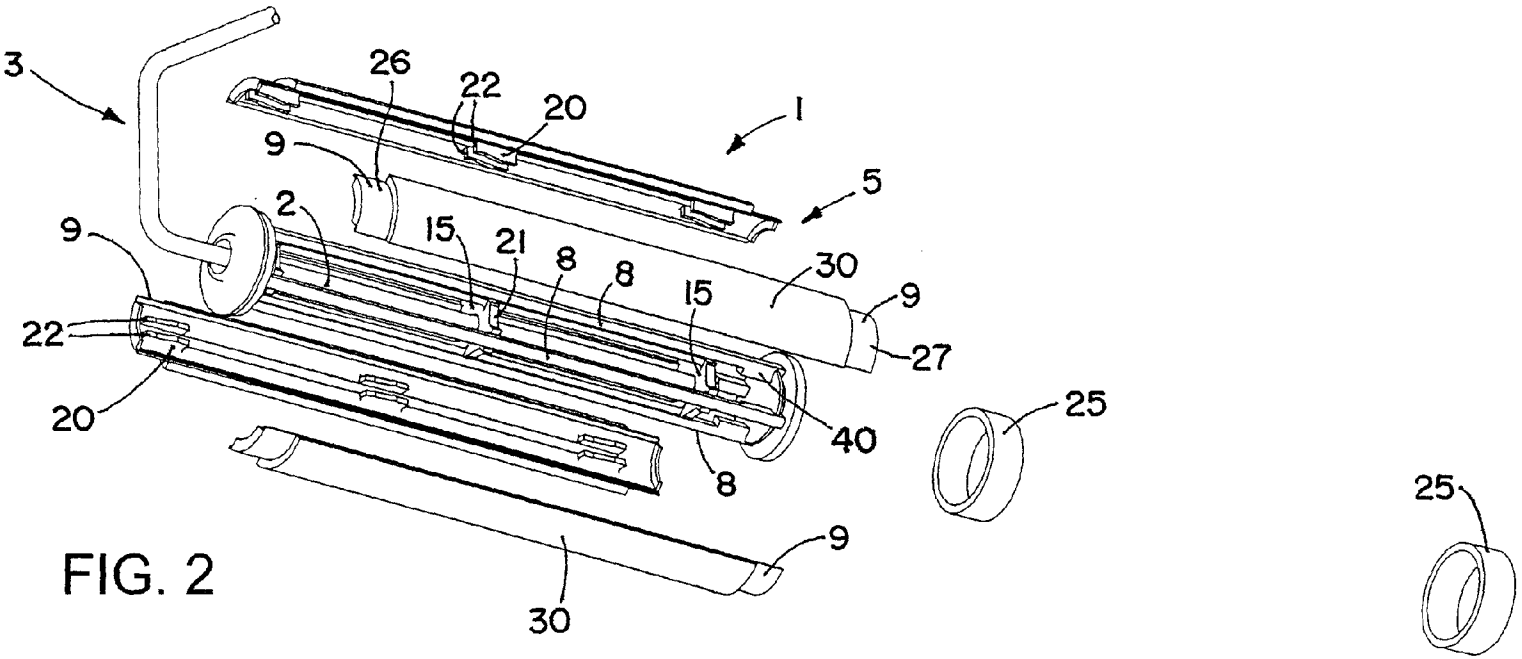
FIG. 2 is an exploded schematic perspective view of the roller cover support of FIG. 1.

Referring now in detail to the drawings, and initially to FIGS. 1-4, there is shown one form of paint roller cover support 1 of the present invention rotatably mounted on a shaft portion 2 of a paint roller frame 3 (only a portion of which is shown). Roller frame 3 may be made from heavy gauge wire or rod bent to shape to provide the shaft portion 2 which may have a right angle bend adjacent the inboard end of the shaft for connection to the handle portion.

Roller cover support 1 includes a plastic cage assembly 5 having axially spaced inboard and outboard end caps 6 and 7 that may be joined together by a plurality of circumferentially spaced, axially extending guide rails 8. Interposed between adjacent pairs of guide rails 8 are elongated semi-cylindrical plastic sleeve segments 9 (see FIG. 4).

Figure 3:
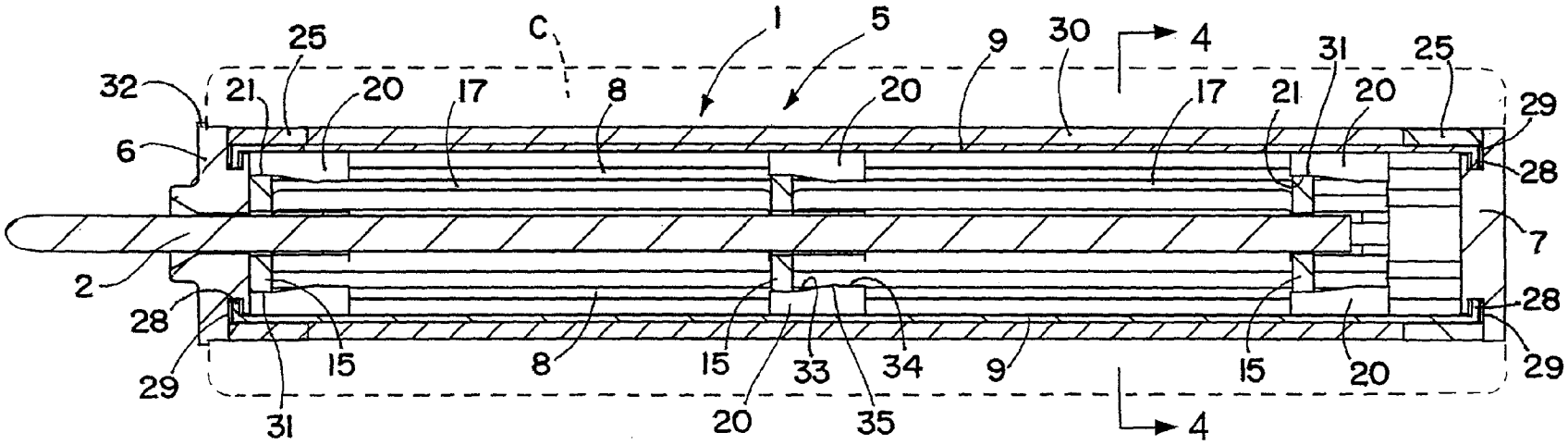
FIG. 3 is an enlarged longitudinal section through the roller cover support of FIG. 1 taken generally along the plane of the line 3-3 thereof, showing a roller cover slidably inserted onto the support.
Figure 4:
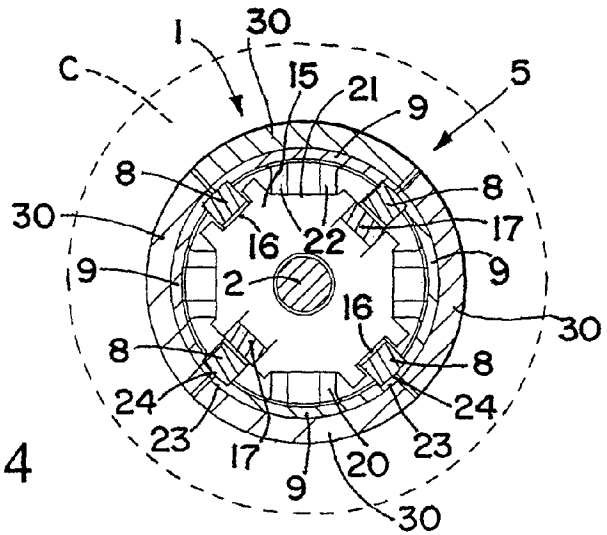
FIG. 4 is a further enlarged transverse section through the roller cover support of FIG. 3, taken generally along the plane of the line 4-4 thereof.
Figure 5:
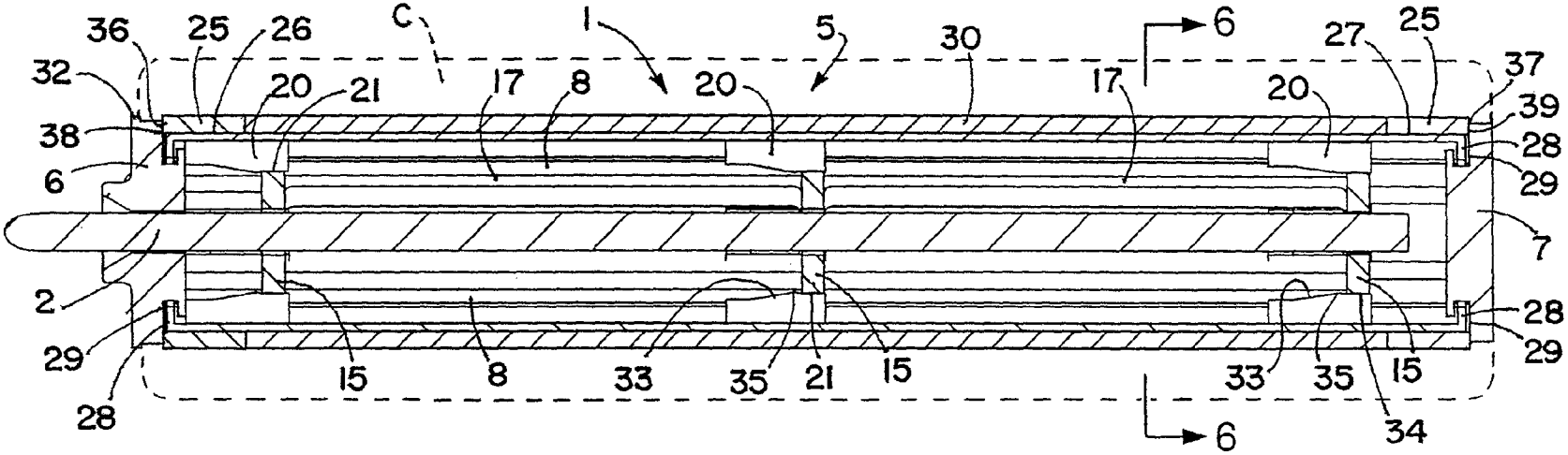
FIG. 5 is an enlarged longitudinal section through the roller cover support similar to FIG. 3 but showing the expandable sleeve segments in the expanded condition for securely retaining the roller cover in place on the support.

Rotatably mounted on the shaft portion 2 in axially fixed relation to one another are a plurality of hub members 15. All of the hub members may have one or more axially aligned slots or notches 16 in their radial outer surfaces for axial sliding engagement by one or more of the guide rails 8 to maintain axial alignment between the cage assembly 5 and hub members 15 during limited axial inward and outward movement of the cage assembly relative to the shaft portion 2 for a purpose to be subsequently described. Such limited axial movement of the cage assembly relative to the shaft portion is accommodated by making the length of the shaft portion that extends through aligned center openings in the inboard end cap 6 and hub members 15 somewhat less than the length of the cage assembly as shown in FIGS. 3 and 5.

In the embodiment disclosed herein, there are four circumferentially spaced guide rails 8 and four sleeve segments 9 interposed between respective adjacent pairs of the guide rails. Also, each of the hub members has two or more circumferentially spaced slots or notches 16 in radial outer surfaces thereof in axial alignment with respective slots or notches in the other hub members for axial sliding engagement by two or more of the guide rails 8. Extending between each of the hub members intermediate the slots or notches are two or more tie rails or rods 17 that may be integrally molded with the hub members for connecting all of the hub members together. Thus only one of the hub members need be fastened against axial movement relative to the shaft portion in any suitable manner, for example, by fitting a self-retaining locking ring (not shown) within the axial outermost hub member for tightly gripping the shaft portion when inserted through the locking ring as disclosed in U.S. Pat. No. 6,378,158.

On the radial inner surface of each of the sleeve segments 9 are a plurality of axially spaced cam members 20 that are engageable with corresponding cam lifters 21 on the hub members 15 to cause radial outward and inward movement of the sleeve segments during axial inward and outward movement of the cage assembly relative to the shaft portion. In the embodiment shown, three sets of axially spaced cam members 20 are provided on each of the sleeve segments 9 for engagement with respective cam lifters 21 on three axially spaced hub members 15 on the shaft portion to minimize inward bowing or bending of the sleeve segments during radial outward movement of the sleeve segments to provide better support for the roller covers to be supported thereby.

Each of the cam members 20 may include two laterally spaced cams 22 for engagement with each of the cam lifters 21 to provide greater stability to the sleeve segments supported thereby. Alternatively, each of the cam members 20 on the sleeve segments 9 may be made transversely wider to provide greater stability to the sleeve segments supported thereby.

Although three hub members 15 and associated cam members 20 on the sleeve segments 9 are shown, it will be appreciated that a greater or lesser number of hub members and associated cam members may be provided if desired. Also, while the cage assembly 5 is shown as having four guide rails 8 each spaced approximately 90° apart and four sleeve segments 9 located therebetween, it will be appreciated that as few as two guide rails and associated sleeve segments may be provided if desired. However, providing the cage assembly with three or more guide rails and associated sleeve segments has the advantage that when the sleeve segments are moved radially outwardly into engagement with the inner diameter of a surrounding roller cover, the semi-cylindrical sleeve segments will provide a substantially cylindrical support for the surrounding roller cover. Also each of the sleeve segments 9 may have outer side edges 23 that overlie outer edges 24 of respective adjacent pairs of guide rails when the sleeve segments are in the radially contracted condition shown in FIG. 4 to minimize the spacing between the outer side edges of the sleeve segments when in the expanded condition shown in FIG. 6.

Sleeve segments 9 are maintained in assembled relation between the respective adjacent pairs of support rails 8 by a pair of elastomeric rings 25 surrounding opposite end portions 26 and 27 of all of the sleeve segments. Rings 25 apply a radial inward tension force on the ends of the sleeve segments for maintaining the cam members 20 on the sleeve segments in sliding engagement with the respective cam lifters 21 on the hub members 20 throughout the range of axial movement of the cage assembly 5 relative to the shaft portion.

The ends of the sleeve segments 9 may have radial inturned flanges 28 to provide added strength and rigidity to the sleeve segments if needed. In that event, radial outwardly opening grooves 29 may be provided in the respective end caps to accommodate the inturned flanges during radial movement of the sleeve segments relative to the end caps.

A layer of elastomeric material 30 desirably substantially completely covers the radial outer surfaces of the sleeve segments 9 except for the end portions 26 and 27 that are surrounded by the elastomeric rings 25. Moreover, the elastomeric material 30 desirably has substantially the same wall thickness as the elastomeric rings 25, whereby when the sleeve segments are expanded radially outwardly, both the elastomeric material and the elastomeric rings will be pressed into frictional engagement with the inner diameter of a surrounding roller cover for securely retaining the roller cover in place on the support. Elastomeric material 30 may be attached to the respective sleeve segments as by over molding the elastomeric material on the sleeve segments or by adhesively bonding or mechanically connecting the elastomeric material to the respective sleeve segments.

When the cage assembly 5 is in the axial outermost position shown in FIG. 3 with the inboard end cap 6 pressed up against the innermost hub member 15 on the shaft portion 2, the sleeve segments 9 are held in the fully contracted condition shown in FIG. 3 by the elastomeric rings 25 which urge the relieved axial inner ends 31 of the cam members 20 on the sleeve segments into engagement with the cam lifters 21 on the hub members 15. When in the fully contracted condition, the radial outer surfaces of the elastomeric material 30 and elastomeric rings 25 desirably substantially correspond to the outermost diameter of the end caps 6 and 7 which is slightly less than the inner diameter of the roller covers to be supported thereby. This makes it very easy to slide a roller cover C onto the roller cover support 1 and up against a stop shoulder 32 on the inboard end cap 6 as schematically shown in FIG. 3.

Figure 6:
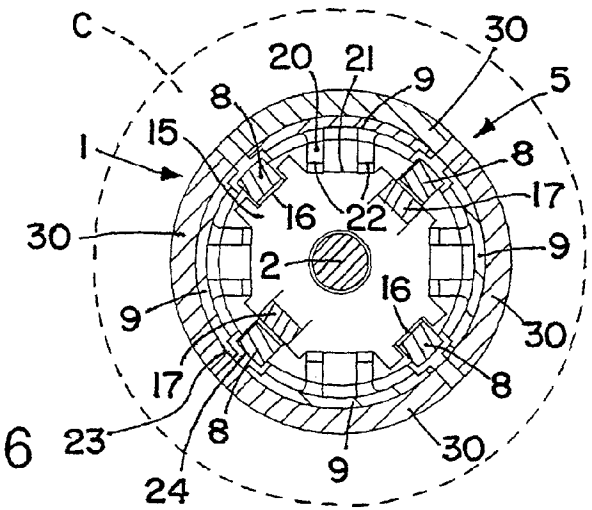
FIG. 6 is a further enlarged transverse section through the roller cover support of FIG. 5, taken generally along the plane of the line 6-6 thereof.

During axial inward movement of the cage assembly 5 relative to the shaft portion 2, radially inwardly sloping walls 33 on the sleeve segment cam members 20 ride up along the hub cam lifters 21 to cause the sleeve segments to move radially outwardly forcing the elastomeric material and elastomeric rings into frictional engagement with the inner diameter of the surrounding roller cover C as schematically shown in FIGS. 5 and 6. If the roller cover has a substantially rigid core, the elastomeric material and elastomeric rings will be compressed against the inner diameter of the rigid core, whereas if the roller cover has a relatively soft core or is coreless, the elastomeric material and elastomeric rings will slightly expand the inner diameter of the roller cover and provide firm frictional contact therewith. In either case, the engagement of the elastomeric material and elastomeric rings with the inner diameter of the roller cover will securely retain the roller cover in place on the support. Also if desired, the outer surface of the elastomeric material and/or elastomeric rings may be textured or ribbed to increase the frictional contact of the elastomeric material and/or elastomeric rings with the inner diameter of the roller cover when the sleeve segments are expanded.

At the radial innermost ends of the radially inwardly sloping walls 33 of cam members 22 are axial walls 34 that engage the hub cam lifters 21 when the cage assembly is pushed all the way in on the shaft portion to limit the extent of radial outward movement of the sleeve segments relative to the shaft portion. A radiused shoulder 35 may be provided on each of the cam members 20 at the juncture between the radially inwardly sloping walls 33 and associated axial walls 34 to resist axial movement of the cage assembly from the axial innermost position shown in FIGS. 5 and 6 to the axial outermost position shown in FIGS. 3 and 4.

Axial movement of the cage assembly 5 between the two extreme end positions shown in FIGS. 3 and 5 may be limited in any suitable manner, for example, by engagement of the inboard end cap 6 with the axial innermost hub member 15 (when moved to the axial outermost position shown in FIG. 3) and engagement of one or more radial shoulders 40 on the guide rails 8 (see FIG. 2) with axial outermost hub member 15 (when moved to the axial innermost position shown in FIG. 5). When the sleeve segments 9 are in the fully expanded condition with the elastomeric material 30 and elastomeric rings 25 pressed into frictional engagement with the inner diameter of the surrounding roller cover, respective ends 36 and 37 of the elastomeric rings 25 may sealingly engage radial outer surfaces 38 and 39 of the respective end caps 6 and 7 as shown in FIG. 5 to prevent paint from migrating between the elastomeric rings and the end caps into the roller cage.

The outboard end cap 7 provides a convenient surface for the user to push against to move the cage assembly 5 from the axial outermost position shown in FIG. 3 to the axial innermost position shown in FIG. 5 to securely retain the roller cover in place on the support.

The roller cover may be released from the support either by pressing the inboard end cap 6 axially outwardly or by wrapping the right angle portion of the roller handle adjacent the roller cover support against the edge of a bucket (with the roller cover support and surrounding roller cover extending into the bucket) to cause the cage assembly 5 to move axially outwardly along the shaft portion 2 to allow the elastomeric rings 25 to return the sleeve segments 9 to the fully retracted condition, thus freeing the roller cover from the support.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means" used to describe such components) are intended to correspond, unless otherwise indicated, to any component which performs the specified function of the described component (e.g., that is functionally equivalent) even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous to any given or particular application.

What is claimed is:

1. A support for rotatably supporting a paint roller cover on a shaft portion of a paint roller frame, the support comprising a cage assembly mounted on the shaft portion for rotation and for limited axial movement in opposite directions relative to the shaft portion, the cage assembly comprising axially spaced inboard and outboard end caps, a plurality of circumferentially spaced, axially extending guide rails interconnecting the respective end caps, and a plurality of elongated semi-cylindrical sleeve segments interposed between adjacent pairs of the guide rails, the shaft portion having a plurality of axially spaced hub members rotatably mounted on the shaft portion in axially fixed relation to one another intermediate the end caps, a plurality of axially spaced cam members on inner surfaces of the sleeve segments engageable with cam lifters on the hub members for causing radial outward and inward movement of the sleeve segments relative to the shaft portion during axial movement of the cage assembly in opposite directions, and elastomeric material attached to radial outer surfaces of each of the sleeve segments that is pressed into frictional engagement with an inner diameter of a surrounding roller cover during radial outward movement of the sleeve segments to securely retain the roller cover in place on the support.

2. The support of claim 1 further comprising elastomeric rings surrounding opposite ends of all of the sleeve segments for maintaining the sleeve segments in assembled relation between the respective adjacent pairs of guide rails.

3. The support of claim 2 wherein the elastomeric rings apply a tension force to the ends of the sleeve segments for maintaining the cam members on the sleeve segments in engagement with the respective cam lifters on the hub members during limited axial movement of the cage assembly in opposite directions.

4. The support of claim 2 wherein the opposite ends of the sleeve segments have inturned radial flanges that are received in radially outwardly opening grooves in the respective end caps.

5. The support of claim 2 wherein respective ends of the elastomeric rings sealingly engage radial outer surfaces of the respective end caps when the sleeve segments are in their radial outermost positions and the elastomeric rings and the elastomeric material are pressed into frictional engagement with an inner diameter of a surrounding roller cover.

6. The support of claim 1 wherein each of the semi-cylindrical sleeve segments has an outer radius slightly less than an inner radius of the roller covers to be supported thereby.

7. The support of claim 6 wherein the sleeve segments have outer side edges that overlie outer edges of the respective adjacent pairs of guide rails when the sleeve segments are in their radial innermost positions.

8. The support of claim 1 wherein one or more of the guide rails is slidably received in aligned slots or notches in the hub members.

9. The support of claim 1 wherein opposite ends of the sleeve segments are free of the elastomeric material, and elastomeric rings surround the opposite ends of all of the sleeve segments for maintaining the cam members on the sleeve segments in engagement with the respective cam lifters on the hub members throughout the limited axial movement of the cage assembly in opposite directions.

10. The support of claim 9 wherein the elastomeric rings and the elastomeric material have substantially the same wall thickness whereby when the sleeve segments are in their radial outermost positions, both the elastomeric rings and the elastomeric material are pressed into frictional engagement with an inner diameter of a surrounding roller cover.

11. The support of claim 9 wherein respective ends of the elastomeric rings sealingly engage radial outer surfaces of the respective end caps when the sleeve segments are in their radial outermost positions and the elastomeric rings and the elastomeric material are pressed into frictional engagement with an inner diameter of a surrounding roller cover.

12. The support of claim 9 wherein the elastomeric rings have an outer radius substantially corresponding to an outer radius of the elastomeric material whereby both the elastomeric material and the elastomeric rings are pressed into frictional engagement with the inner diameter of a surrounding roller cover during radial outward movement on the sleeve segments.

13. The support of claim 12 wherein the sleeve segments have outer side edges that overlie outer edges of the respective adjacent pairs of guide rails when the sleeve segments are in their radial innermost positions.

14. A support for rotatably supporting a paint roller cover on a shaft portion of a paint roller frame, the support comprising a cage assembly mounted on the shaft portion for rotation and for limited axial movement in opposite directions along the shaft portion, the cage assembly comprising axially spaced inboard and outboard end caps joined together by a plurality of circumferentially spaced, axially extending guide rails, a plurality of elongated semi-cylindrical sleeve segments interposed between adjacent pairs of the guide rails, a plurality of axially spaced hub members rotatably mounted on the shaft portion in axially fixed relation to one another, a plurality of axially spaced cam members on inner surfaces of the sleeve segments engageable with cam lifters on the hub members, and elastomeric rings surrounding opposite ends of all of the sleeve segments for maintaining the cam surfaces on the sleeve segments in engagement with the cam lifters on the hub members during limited axial movement of the cage assembly in opposite directions, the cam members being configured to cause radial outward and inward movement of the sleeve segments relative to the shaft portion during axial inward and outward movement of the cage assembly along the shaft portion, and elastomeric material covering a substantial portion of radial outer surfaces of the semi-cylindrical sleeve segments intermediate the elastomeric rings that is pressed into frictional engagement with an inner diameter of a surrounding roller cover during radial outward movement of the sleeve segments for securely retaining the roller cover in place on the support.

15. The support of claim 14 wherein the elastomeric rings and the elastomeric material have substantially the same wall thickness whereby when the sleeve segments are in their radial outermost positions, both the elastomeric rings and the elastomeric material are pressed into frictional engagement with the inner diameter of a surrounding roller cover.

16. The support of claim 15 wherein respective ends of the elastomeric rings sealingly engage radial outer surfaces of the respective end caps when the sleeve segments are in their radial outermost positions.

17. A support for rotatably supporting a paint roller cover on a shaft portion of a paint roller frame, the support comprising a cage assembly mounted on the shaft portion for rotation and for limited axial movement in opposite directions relative to the shaft portion, and a plurality of circumferentially spaced axially extending semi-cylindrical sleeve segments each having a plurality of axially spaced cam members, and a plurality of axially spaced hub members rotatably mounted on the shaft portion in axially fixed relation to one another, the cam members being engageable with cam lifters on the hub members during axial movement of the cage assembly in opposite directions to cause radial outward and inward movement of the sleeve segments relative to the shaft portion, and elastomeric rings surrounding opposite ends of all of the sleeve segments for maintaining the cam members on the sleeve segments in engagement with the cam lifters on the respective hub members during limited axial movement of the cage assembly in opposite directions.

18. The support of claim 17 further comprising elastomeric material attached to radial outer surfaces of each of the sleeve segments intermediate the elastomeric rings that is pressed into frictional engagement with an inner diameter of a surrounding roller cover during radial outward movement of the sleeve segments for securely retaining the roller cover in place on the support.

19. The support of claim 18 wherein the elastomeric rings and the elastomeric material have substantially the same wall thickness whereby when the sleeve segments are in their radial outermost positions, both the elastomeric rings and the elastomeric material are pressed into frictional engagement with the inner diameter of a surrounding roller cover.

20. The support of claim 19 wherein the cage assembly comprises axially spaced inboard and outboard end caps, and respective ends of the elastomeric rings sealingly engage radial outer surfaces of the respective end caps when the sleeve segments are in their radial outermost positions and the elastomeric rings and the elastomeric material are pressed into frictional engagement with an inner diameter of a surrounding roller cover.

* * * * *